US007420161B2

(12) United States Patent
Kovtoun

(10) Patent No.: US 7,420,161 B2
(45) Date of Patent: Sep. 2, 2008

(54) BRANCHED RADIO FREQUENCY MULTIPOLE

(75) Inventor: Viatcheslav V. Kovtoun, Santa Clara, CA (US)

(73) Assignee: Thermo Finnigan LLC, San Jose, CA (US)

( * ) Notice: Subject to any disclaimer, the term of this patent is extended or adjusted under 35 U.S.C. 154(b) by 261 days.

(21) Appl. No.: 11/373,354

(22) Filed: Mar. 9, 2006

(65) Prior Publication Data

US 2008/0061227 A1 Mar. 13, 2008

(51) Int. Cl.
*H01J 49/42* (2006.01)
*H01J 49/40* (2006.01)

(52) U.S. Cl. ..... 250/293; 250/281; 250/282; 250/288; 250/290; 250/292

(58) Field of Classification Search ..... 250/281–297, 250/396 R, 398
See application file for complete search history.

(56) References Cited

U.S. PATENT DOCUMENTS

| | | | | |
|---|---|---|---|---|
| 5,468,958 | A | 11/1995 | Franzen et al. | |
| 5,825,026 | A | 10/1998 | Baykut | |
| 6,891,157 | B2 | 5/2005 | Bateman et al. | |
| 6,950,072 | B2 | 9/2005 | Miyata et al. | |
| 6,967,340 | B2 | 11/2005 | Lee et al. | |
| 6,987,261 | B2 * | 1/2006 | Horning et al. | 250/282 |
| 7,196,326 | B2 * | 3/2007 | Franzen et al. | 250/288 |
| 7,309,861 | B2 * | 12/2007 | Brown et al. | 250/290 |
| 7,342,224 | B2 * | 3/2008 | Makarov et al. | 250/290 |
| 2001/0035498 | A1 * | 11/2001 | Li et al. | 250/398 |
| 2002/0125421 | A1 * | 9/2002 | Yoshinari et al. | 250/281 |
| 2004/0026614 | A1 * | 2/2004 | Bateman et al. | 250/281 |
| 2004/0217272 | A1 * | 11/2004 | Horning et al. | 250/282 |
| 2006/0076484 | A1 * | 4/2006 | Brown et al. | 250/290 |
| 2006/0284080 | A1 * | 12/2006 | Makarov et al. | 250/286 |
| 2007/0057178 | A1 | 3/2007 | Chernushevich et al. | |
| 2007/0278397 | A1 * | 12/2007 | Bateman et al. | 250/286 |
| 2008/0061227 | A1 * | 3/2008 | Kovtoun | 250/292 |

FOREIGN PATENT DOCUMENTS

WO WO 2004/023516 A1 3/2004

* cited by examiner

*Primary Examiner*—Bernard E Souw
(74) *Attorney, Agent, or Firm*—Carr & Ferrell LLP; Charles B. Katz

(57) ABSTRACT

Systems and methods of the invention include a branched radio frequency multipole configured to act, for example, as an ion guide. The branched radio frequency multipole comprises multiple ion channels through which ions can be alternatively directed. The branched radio frequency multipole is configured to control which of the multiple ion channels ions are directed, through the application of appropriate potentials. Thus, ions can alternatively be directed down different ion channels without the use of a mechanical valve.

26 Claims, 8 Drawing Sheets

BRANCHED RADIO FREQUENCY MULTIPOLE

BACKGROUND OF THE INVENTION

1. Field of the Invention

The invention is in the field of ion optics.

2. Description of Related Art

Ion guides comprising four electrodes are used to transportions from one place to another. For example, in mass spectrometry ion guides may be used to transportions from an ion source to an ion analyzer. Some types of ion guides operate using radio frequency potentials applied to the four electrodes. Neighboring electrodes (orthogonal to each other) in the ion guide are operated at potentials of opposite polarity, while opposing electrodes in the ion guide are operated at the same potentials. The use of appropriate potentials results in the generation of a quadrupole field and an ion channel through which ions will preferentially travel. In some instances, such ion guides also operate as a mass filter or collision cell.

SUMMARY OF THE INVENTION

Systems and methods of the invention include a branched radio frequency multipole configured to act as an ion guide. The branched radio frequency multipole comprises multiple ion channels through which ions can be alternatively directed. The branched radio frequency multipole is configured to control which of the multiple ion channels ions are directed, through the application of appropriate potentials. Thus, ions can alternatively be directed down different ion channels without the use of a mechanical valve.

In some embodiments, the branched radio frequency multipole is used to alternatively direct ions from one ion source to more than one alternative ion destination. For example, the branched radio frequency multipole can be configured to direct an ion from an ion source to one of two alternative mass spectrometers. In some embodiments, the branched radio frequency multipole is used to direct ions from alternative ion sources to a single ion destination. For example, the branched radio frequency multipole can be configured to direct ions alternatively from an electron impact ion source and an atmospheric pressure ion source to a single mass spectrometer.

In some embodiments, the branched radio frequency multipole is used as a collision cell. In some embodiments, the branched radio frequency multipole is configured to act as a mass filter.

In some embodiments, the branched radio frequency multipole comprises at least a first branched electrode and a second branched electrode disposed parallel to each other, and a plurality of orthogonal electrodes disposed orthogonally to the first branched electrode and the second branched electrode. The branched electrodes and the orthogonal electrodes are configured to form an ion guide comprising at least a first ion channel and a second ion channel that diverge at a branch point. The first ion channel and the second ion channel overlap in part of the branched radio frequency multipole and diverge at the branch point.

The system also comprises a radio frequency voltage source for applying radio frequency voltages to the first branched electrode, the second branched electrode, and the plurality of orthogonal electrodes. The amplitude and/or phase of the radio frequency voltages are selected for establishing a radio frequency potentials configured to form regions of ion stability in alternatively the first ion channel or the second ion channel and, thus, direct ions alternatively through the first ion channel or the second ion channel, respectively.

In some embodiments, the invention comprises a method of using a branched radio frequency multipole, the method comprising setting voltages on segments of the branched electrodes and/or the orthogonal electrodes such that ions are directed down alternatively the first ion channel or the second ion channel.

In some embodiments, the invention includes a method of using a branched radio frequency multipole, the method comprising setting radio frequency voltages such that the radio frequency voltages opposite a first ion channel are different from the radio frequency voltages in a second ion channel. The method also comprises applying radio frequency voltages to orthogonal electrodes and branched electrodes in an opposite polarity alternating in time. The method also comprises introducing an ion from an ion source into the ion guide through an ion inlet and passing the ion to a first ion destination through the first ion channel. The method also comprises introducing a second ion from the ion source into the ion guide through an ion inlet and passing the second ion to a second ion destination through the second ion channel.

DETAILED DESCRIPTION

The invention comprises a branched radio frequency multipole for guiding ions from a source toward alternative ion destinations, or from a plurality of ion sources to an ion destination. The invention may comprise two ion destinations or two ion sources. The branched radio frequency multipole comprises electrodes divided into segments, and is configured to guide ions through different ion channels by applying different radio frequency (RF) voltages to these segments.

Figure 1:
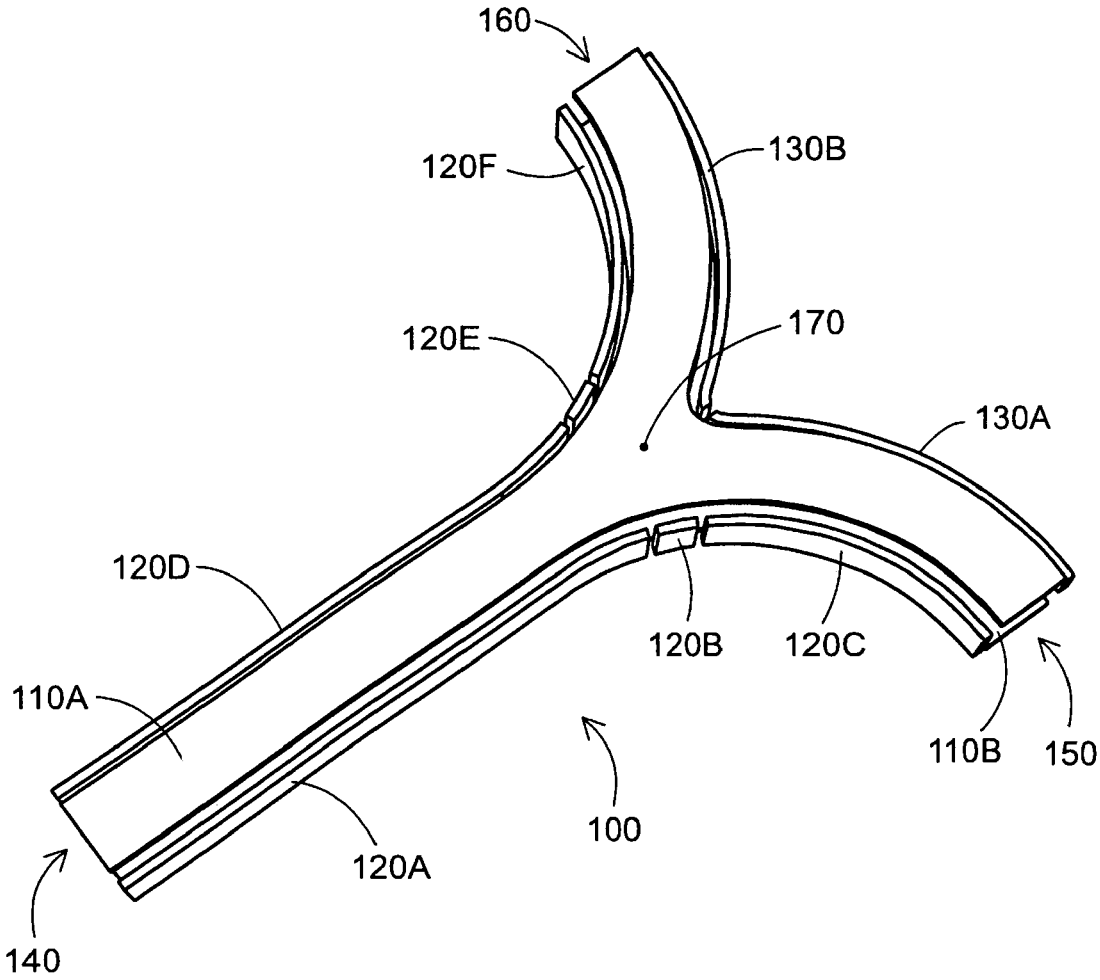
FIG. 1 illustrates a perspective view of a branched radio frequency multipole system, according to various embodiments of the invention.

FIG. 1 illustrates a perspective view of a branched radio frequency multipole system, according to various embodiments of the invention. Branched radio frequency multipole system 100 comprises branched electrodes 110*a* and 110*b*, disposed parallel to each other. Branched radio frequency multipole system also comprises orthogonal electrodes 120A, 120B, 120C, 120D, 120E, 120F, 130A, and 130B. The orthogonal electrodes 120A-120F, 130A, and 130B are disposed orthogonally to the branched electrodes 110A and 110B such that the branched radio frequency multipole 100 comprises a first ion channel between ports 140 and 150 and a second ion channel between ports 140 and 160 of branched radio frequency multipole 100. Port 140 is an opening defined by the branched electrodes 110A and 110B and the orthogonal electrodes 120A and 120D. Port 150 is an opening defined by the branched electrodes 110A and 110B and the orthogonal electrodes 120C and 130A. Port 160 is an opening defined by the branched electrodes 110A and 110B and the orthogonal electrodes 120F and 130B. The first ion channel and the second ion channel overlap in part of the branched radio frequency multipole 100 adjacent to port 140 and diverge at a branch point 170 before continuing to port 150 and port 160, respectively.

The RF voltages applied to orthogonal electrodes 120B, 120C and 130A may be controlled such that the first ion channel comprising a path between port 140 and port 150 is opened. Alternatively, the RF voltages applied to orthogonal electrodes 120E, 120F, and 130B may be controlled such that the second ion channel comprising a path between port 140 and port 160 is opened. Thus, the paths by which ions traverse branched radio frequency multipole 100 can be controlled by the selection of appropriate voltages.

Figure 2:
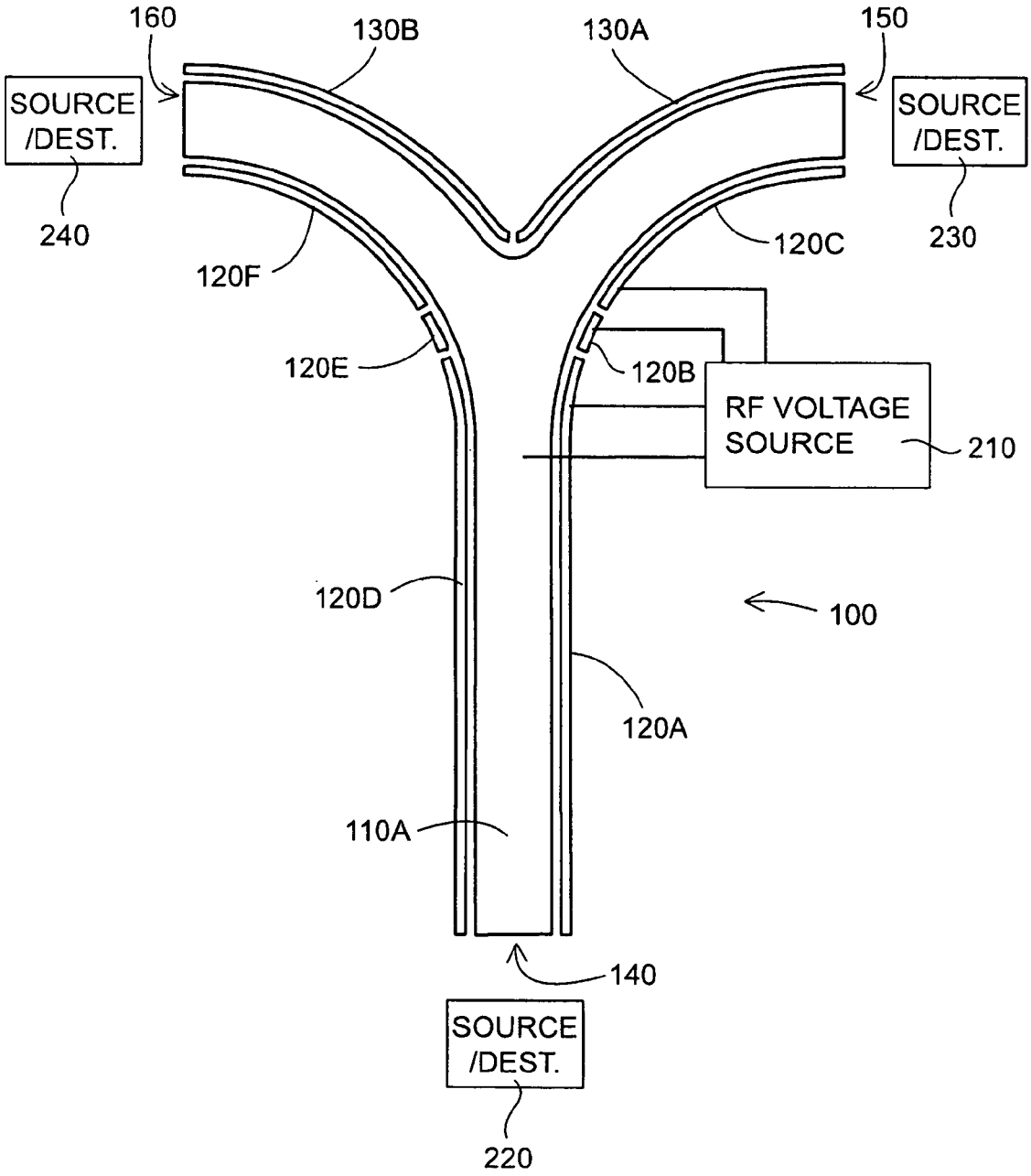
FIG. 2 illustrates a top view of the branched radio frequency multipole system of FIG. 1, having orthogonal electrodes split into segments, according to various embodiments of the invention.

FIG. 2 illustrates a top view of the branched radio frequency multipole system 100 of FIG. 1, having orthogonal electrodes split into segments, according to various embodiments of the invention. The branched radio frequency multipole system 100 also comprises a radio frequency voltage source 210. Radio frequency voltage source 210 may be coupled to the orthogonal electrodes 120A, 120B, 120C, 120D, 120E, 120F, 130A, and 130B. Several, but not all, of these connections are shown in FIG. 2. Radio frequency voltage source 210 may also be coupled to the branched electrodes, e.g. 110A and 110B.

The RF voltages applied to orthogonal electrodes 120A-120F, 130A, 130B, and branched electrodes 110A and 110B may be controlled such that the first ion channel comprising a path between port 140 and port 150 is opened. For example, the RF voltages applied to orthogonal electrodes 120A-120F, 130A and 130B may be controlled such that the RF voltage on orthogonal electrode 120E-120F and 130B is at least 1.1, 1.5, 2, or 3 times the RF voltage on orthogonal electrodes 120A-120D and 130A. Alternatively, the RF voltages applied to orthogonal electrodes 120A-120F, 130A, 130B and branched electrodes 110A and 110B may be controlled such that the second ion channel comprising a path between port 140 and port 160 is opened. For example, the RF voltages on orthogonal electrodes 120A-120F, 130A and 130B may be controlled such that the RF voltage on orthogonal electrode 120B-120C and 130A is at least 1.1, 1.5, 2, or 3 e times the RF voltage on orthogonal electrodes 120A, 120D-120F and 130B.

The branched radio frequency multipole system 100 also comprises optional ion source/destinations 220, 230, and 240. Ion source/destination 220, ion source/destination 230, and ion source/destination 240 may each be an ion source and/or an ion destination. As ion sources they may comprise, for example, an electron impact (EI) ion source, an electrospray (ESI) ion source, a matrix-assisted laser desorption (MALDI) ion source, a plasma source, an atmospheric pressure chemical ionization (APCI) ion source, a laser desorption ionization (LDI) ion source, an inductively coupled plasma (ICP) ion source, a chemical ionization (CI) ion source, a fast atom bombardment (FAB) ion source, an electron source, a liquid secondary ions mass spectrometry (LSMIS) source, or the like. As ion destinations they may comprise, for example, a mass filter, a chemical analyzer, material to be treated by the ion, a time of flight (TOF) mass analyzer, a quadrupole mass analyzer, a Fourier transform ion cyclotron resonance (FTICR) mass analyzer, a 2D (linear) quadrupole, a 3d quadrupole ion trap, a magnetic sector mass analyzer, a spectroscopic detector, a photomultiplier, a ion detector, an ion reaction chamber, or the like.

Figure 3:
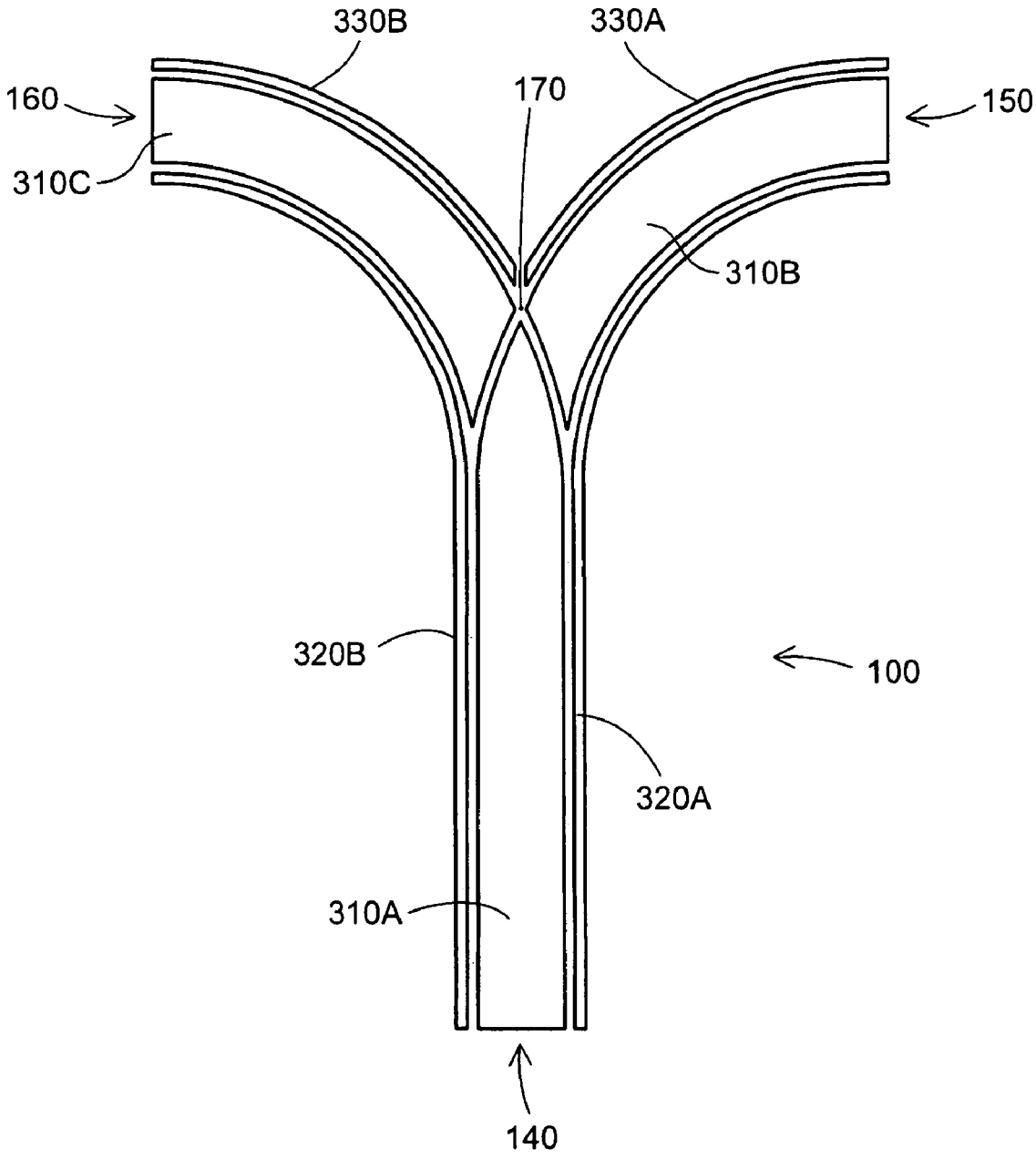
FIG. 3 illustrates a top view of a branched radio frequency multipole system, having branched electrodes split into segments, according to various embodiments of the invention.

FIG. 3 illustrates a top view of the branched radio frequency multipole system 100, wherein branched electrodes 110A and 110B are each split into segments, according to various embodiments of the invention. In these embodiments, branched electrode 110 and branched electrode 110B each include electrode segments 310A, 310B, and 310C. The electrode segments 310A, 310B, and 310C are disposed relative to each other such that a branched shape is formed. Branched radio frequency multipole system 100 also comprises orthogonal electrodes 320A, 320B, 330A, and 330B, disposed orthogonally to electrode segments 310A, 310B, and 310C.

RF voltages applied to electrode segment 310C and orthogonal electrodes 320A, 320B, 330A, and 330B may be controlled such that ions are directed through the first ion channel between port 140 and port 150. When an ion channel is open, those members of electrode segments 310A, 310B, and 310C that are adjacent to the open channel are normally operated at RF voltages having a polarity opposite of an RF voltage applied to the orthogonal electrodes 320A, 320B, 330A and 330B. When part of an ion channel is closed, this relationship between electrode segments of the branched electrodes and the orthogonal electrodes is not maintained, e.g. the same potentials may be applied to both a segment of the branched electrodes and the orthogonal electrodes.

For example, the RF voltage applied to electrode segment 310C may be to the same as the RF voltages applied to orthogonal electrodes 320A, 320B, 330A, and 330B. Setting the same potential on all four electrodes forming a branch of an ion channel allows the ion guide to reproduce an electric potential distribution closely analogous to a theoretical electric potential distribution if electrode segment 330A were continued following its curvature until it merged into electrode segment 320B. This configuration would be effectively equivalent, in terms of electric field distribution and ion transfer, to a regular curved four-electrode set. In this case, ions will successfully be passed through the first ion channel between port 140 and port 150, but will not traverse between port 160 and port 140. Alternatively, the RF voltages applied to electrode segment 310B and orthogonal electrodes 320A, 320B, 330A, and 330B may be the same. In this case, ions are directed through the second ion channel between port 140 and port 160 and will not successfully pass between port 140 and port 150.

Figure 4A:
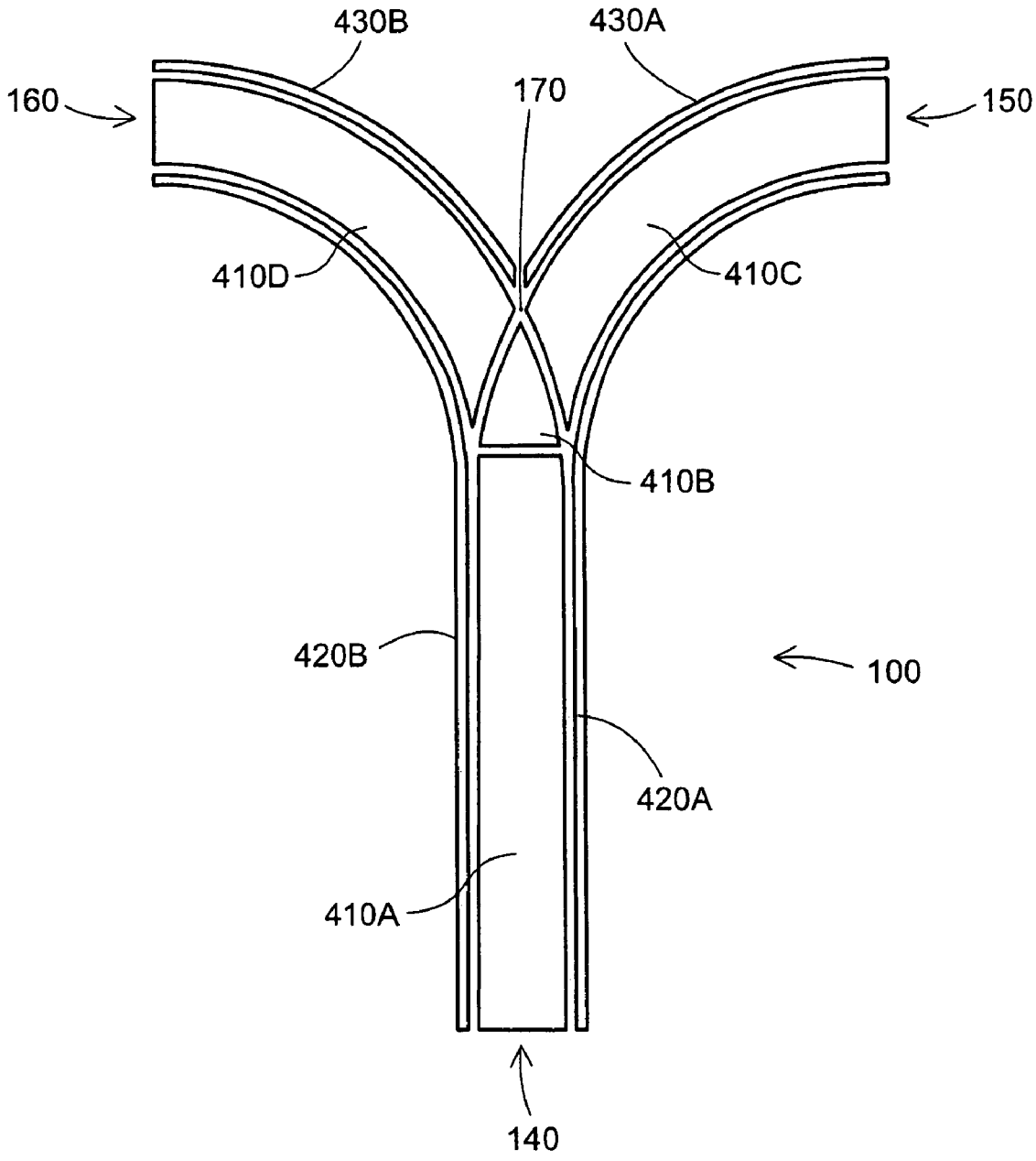
FIG. 4A illustrates a top view of a branched radio frequency multipole system, having a branched electrode split into segments, according to various embodiments of the invention.

FIG. 4A illustrates a top view of the branched radio frequency multipole system 100, wherein the branched electrodes 110A and 110B are each split into segments, according to various embodiments of the invention. The branched electrode 110A is split into segments 410A, 410B, 410C, and 410D, which are disposed relative to each other such that a branched shape is formed. Orthogonal electrodes 420A, 420B, 430A, and 430B are disposed orthogonally to the electrode segments 410A, 410B, 410C, and 410D.

In a manner similar to that described in FIG. 3, RF voltages may be applied to electrode segments 410A, 410B, 410C, 410D and orthogonal electrodes 420A, 420B, 430A and 430B in order to open the first ion channel between port 140 and port 150, or alternatively, the second ion channel between port 140 and port 160. Electrode segment 410B is typically maintained at the same RF voltages as electrode segment 410A.

Figure 4B:
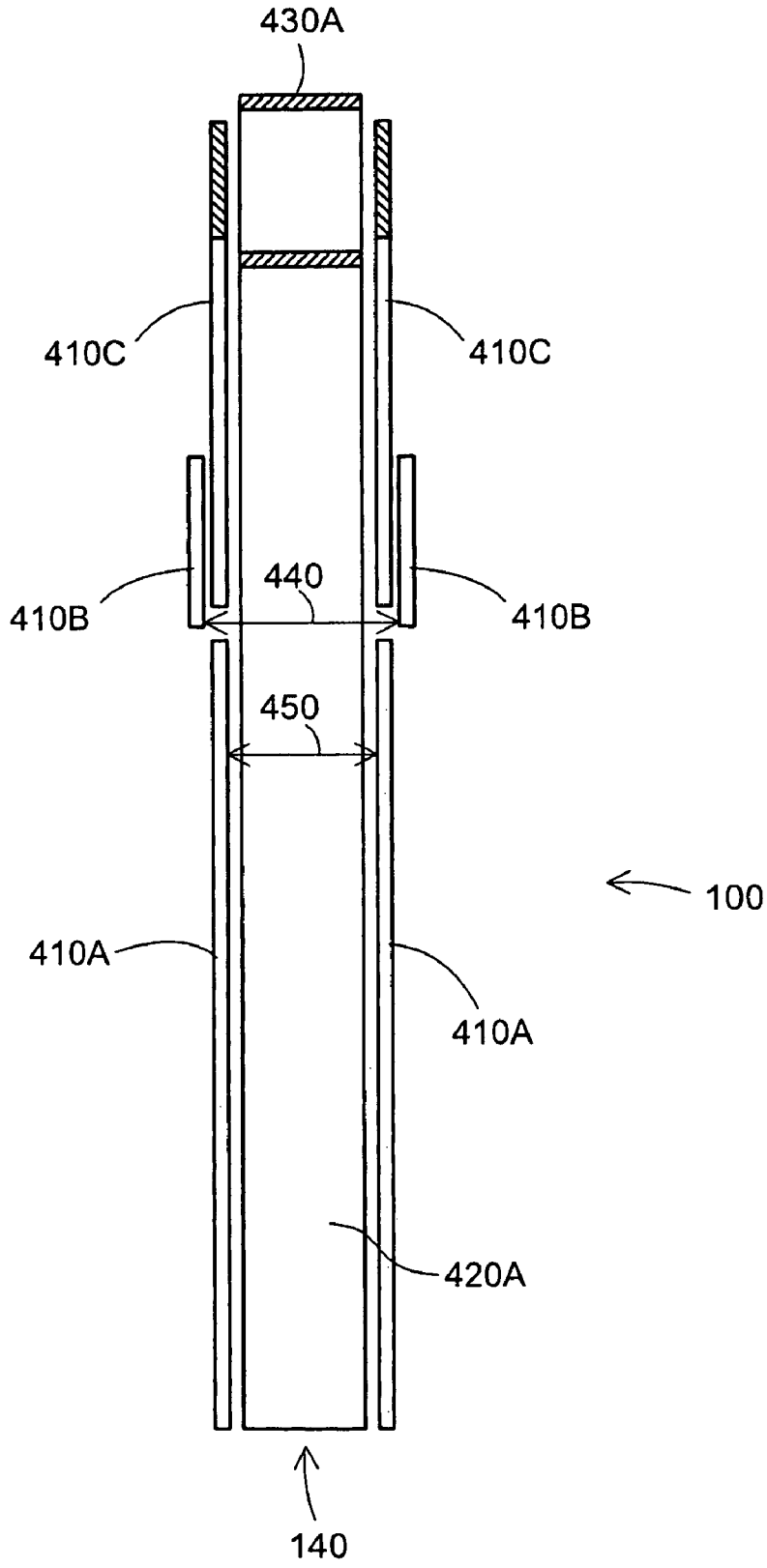
FIG. 4B illustrates a side view of the branched radio frequency multipole system of FIG. 4A, according to various embodiments of the invention.

FIG. 4B illustrates a side view of the branched radio frequency multipole system 100 of FIG. 4A, according to various embodiments of the invention. This view shows that electrode segment 410B is displaced relative to electrode segment 410A. Specifically, an inter-electrode distance 440 between the two instances of electrode segment 410B that make up part of branched electrode 110A and 110B (FIG. 1) is greater than an inter-electrode distance 450 between the two instances of electrode segment 410A that make up part of branched electrode 110A and 110B. In various embodiments, the inter-electrode distance 440 differs from the inter-electrode distance 450 by greater than 4, 8, 12 or 15 percent of inter-electrode distance 450. In some instances, the embodiments of branched radio frequency multipole 100 illustrated by FIGS. 4A and 4B provide a greater control of the opening and closing of ion channels than the embodiments illustrated by FIG. 3. For example, the embodiments illustrated by FIGS. 4A and 4B allow for better shaping of the electric potential close to electrode 410B where the most significant distortion of electric field occurs because of electrode branching. This may result in better ion transmission efficiency in the open channel. In alternative embodiments, electrode segments 410A and 410B are a single piece shaped to achieve the inter-electrode distances 440 and 450.

Figure 5:
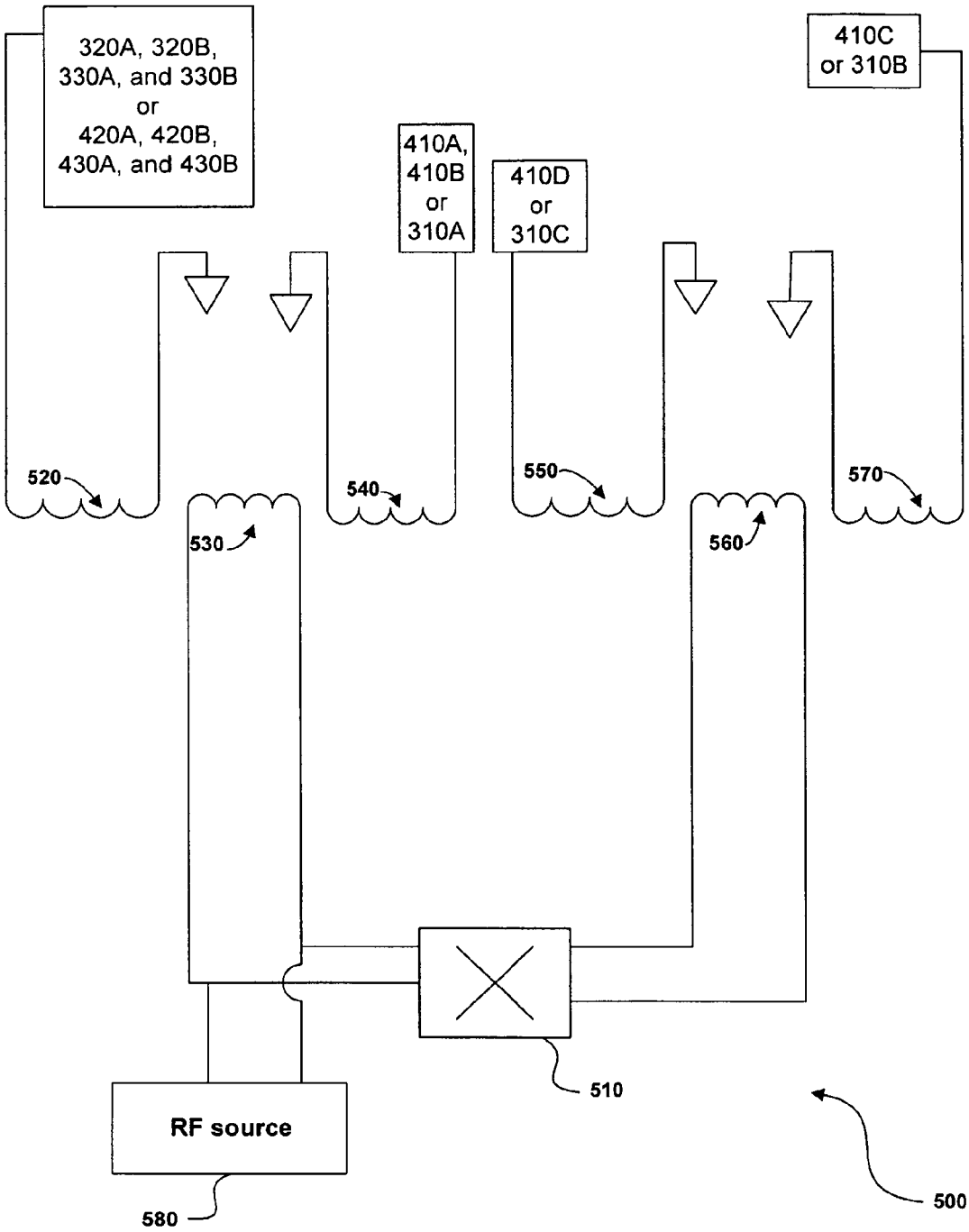
FIG. 5 is a diagram of a circuit configured to supply radio frequency potentials to a branched radio frequency multipole system, according to various embodiments of the invention.

FIG. 5 is a diagram of a circuit configured to supply radio frequency voltages to a branched radio frequency multipole system, according to various embodiments of the invention. Circuit 500 is optionally included in radio frequency voltage source 210. Circuit 500 comprises a phase switch 510, inductors 520, 530, 540, 550, 560, and 570, and an RF source 580. The phase of RF voltages on inductors 530 and 560 are dependent on the state of the phase switch 510. When phase switch 510 is OFF, both of these inductors will have the same RF voltages. When phase switch 510 is ON, inductors 530 and 560 will have RF voltages of opposite polarity, e.g. be 180 degrees out of phase with each other. Inductors 520 and 540 respond to the inductance on inductor 530. Inductors 550 and 570 respond to the inductance on inductor 560. Thus, depending on whether the phase switch is on or off, one of 410D (or 310C) and 410C (or 310B) will have the same polarity as 410A, 410B, while the other will have the opposite polarity. Ion channels will be opened and closed accordingly. With this circuit 500, turning on and off the phase switch 510 can be used to open and close ion channels in the branched radio frequency multipole 100.

Figure 6:
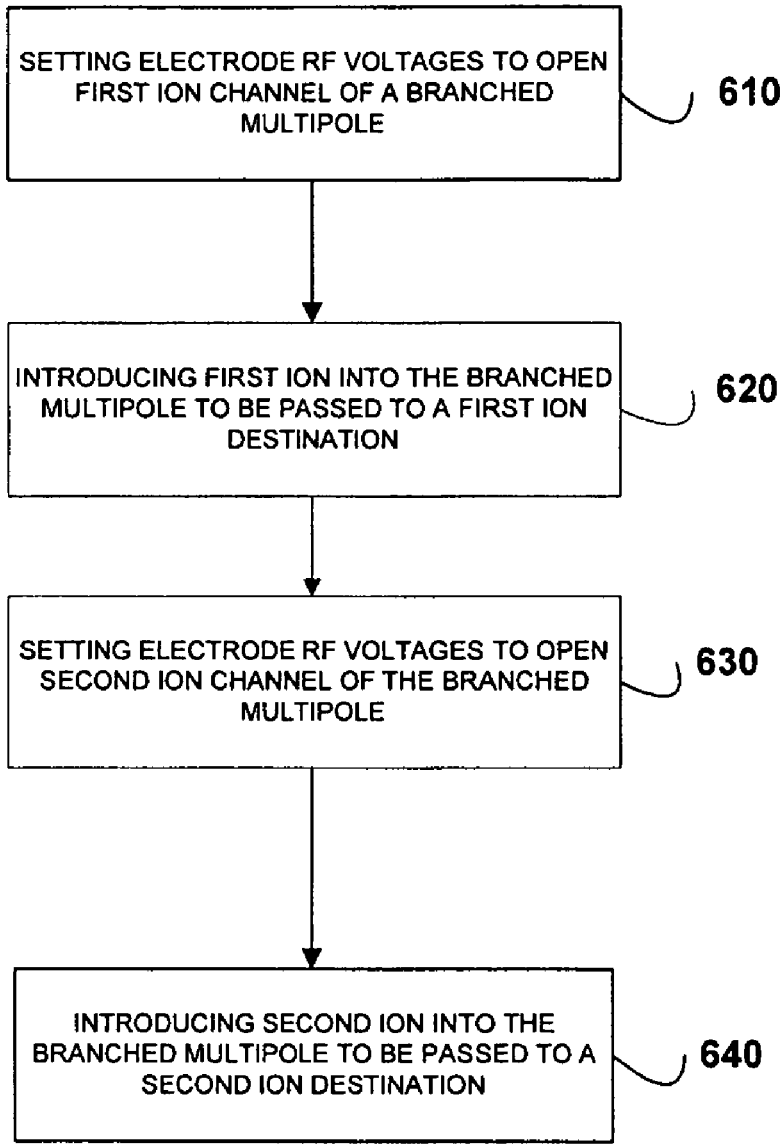
FIG. 6 is a flowchart illustrating a method, according to various embodiments of the invention.

FIG. 6 is a flowchart illustrating a method, according to various embodiments of the invention. In this method, electrode RF voltages are adjusted to alternatively pass ions to different destinations. A step 610 comprises setting electrode RF voltages such that the first ion channel between ports 140 and 150 of the branched radio frequency multipole 100 is opened to allow a first ion from an ion source, e.g. ion source/destination 220, to pass through the first ion channel toward a first ion destination, e.g. ion source/destination 230. A step 620 comprises introducing the first ion into the branched radio frequency multipole 100 and passing the first ion to the first ion destination. A step 630 comprises setting electrode RF voltages such that the second ion channel between ports 140 and 160 of the branched radio frequency multipole 100 is opened to allow a first ion from an ion source, e.g. ion source/destination 220, to pass through the first ion channel toward a second ion destination, e.g. ion source/destination 240. A step 640 comprises introducing the second ion into the branched radio frequency multipole 100 and passing the second ion to the second ion destination.

Figure 7:
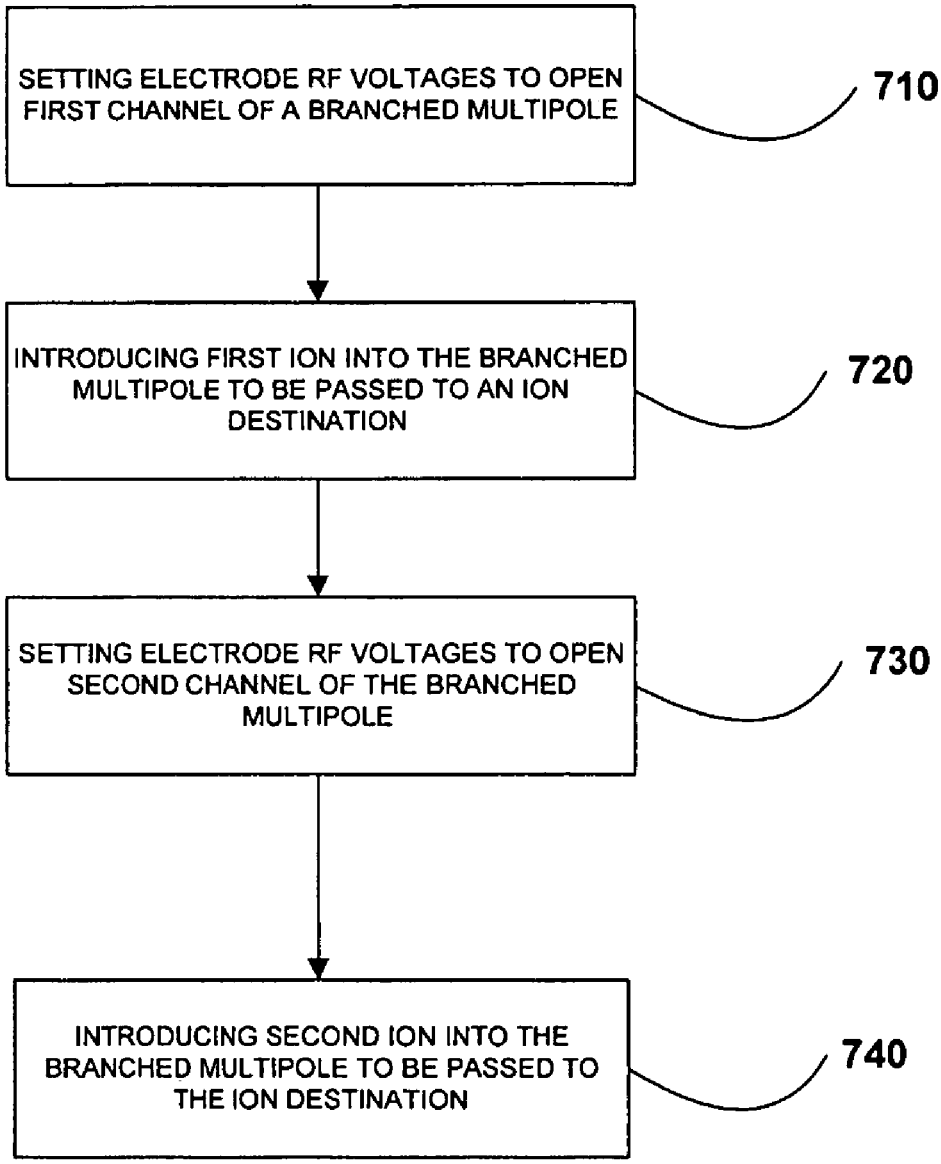
FIG. 7 is a flowchart illustrating an alternative method, according to various embodiments of the invention.

FIG. 7 is a flowchart illustrating a method, according to various embodiments of the invention. In this method, electrode RF voltages are adjusted to alternatively pass ions to different destinations. A step 710 comprises setting electrode RF voltages such that the first ion channel between ports 140 and 150 of the branched radio frequency multipole 100 is opened to allow a first ion from a first ion source, e.g. ion source/destination 230, to pass through the first ion channel toward an ion destination, e.g. ion source/destination 220. A step 720 comprises introducing the first ion into the branched radio frequency multipole 100 and passing the first ion to the ion destination. A step 730 comprises setting electrode RF voltages such that the second ion channel between ports 140 and 160 of the branched radio frequency multipole 100 is opened to allow a first ion from a second ion source, e.g. ion source/destination 240, to pass through the first ion channel toward the ion destination, e.g. ion source/destination 220. A step 740 comprises introducing the second ion into the branched radio frequency multipole 100 and passing the second ion to the ion destination.

Several embodiments are specifically illustrated and/or described herein. However, it will be appreciated that modifications and variations are covered by the above teachings and within the scope of the appended claims without departing from the spirit and intended scope thereof. For example, the branched electrodes discussed herein may be curved on sides facing toward the first ion channel and the second ion channel. E.g., the branched electrodes may be parabolic or round. For example, in some embodiments, branched radio frequency multipole 100 may be used as a collision cell or as a mass filter. For example, the segmentation of the orthogonal electrodes illustrated in FIG. 2 can be used in combination with segmentation of the branched electrodes illustrated in FIGS. 3, 4A, and 4B.

Collision gas can be used to reduce significant excursion of ion trajectories from a center line of the ion guide because of collisional damping. This may simplify forming appropriate electric fields using a combination of electrode segments and associated voltages. For example, with collisional dampening, a spatial region that preferably approximates a standard curved four-electrode ion guide may be reduced to a narrow spatial region around the center line of ion trajectories, relative to a system without collisional damping.

The embodiments discussed herein are illustrative of the present invention. As these embodiments of the present invention are described with reference to illustrations, various modifications or adaptations of the methods and/or specific structures described may become apparent to those skilled in the art. All such modifications, adaptations, or variations that rely upon the teachings of the present invention, and through which those teachings have advanced the art, are considered to be within the spirit and scope of the present invention. Hence, these descriptions and drawings should not be considered in a limiting sense, as it is understood that the present invention is in no way limited to only the embodiments illustrated.

What is claimed is:

1. A system comprising:

a first branched electrode;

a second branched electrode;

a plurality of orthogonal electrodes disposed orthogonally to the first branched electrode and the second branched electrode, the first branched electrode, the second branched electrode, and the plurality of orthogonal electrodes being configured to form an ion guide comprising a first ion channel and a second ion channel and a branch point where the first ion channel and the second ion channel diverge; and a radio frequency voltage source for applying radio frequency voltages to the first branched electrode, the second branched electrode, and the plurality of orthogonal electrodes, the amplitude and/or phase of the radio frequency voltages being selected for establishing a region of ion transmission stability in alternatively the first ion channel or the second ion channel and thus directing ions alternatively through the first ion channel or the second ion channel, respectively.

2. The system of claim 1, wherein the orthogonal electrodes are each divided into a plurality of segments, and a first subset of the plurality of segments of the orthogonal electrodes disposed adjacent to the branch point is configured to be maintained at a different radio frequency voltage than a second subset of the plurality of segments of the orthogonal electrodes.

3. The system of claim 2, wherein a difference in radio frequency voltage between the first subset of the plurality of segments of the orthogonal electrodes and the second subset of the plurality of segments of the orthogonal electrodes is greater than a factor of 1.1.

4. The system of claim 1, wherein the first branched electrode and the second branched electrode are each divided into a plurality of segments; and at least a first segment of the plurality of segments is configured to be maintained at a different radio frequency voltage than a second segment of the plurality of segments disposed.

5. The system of claim 4, wherein the orthogonal electrodes are configured as a plurality of orthogonal segments, where a first subset of the plurality of orthogonal segments disposed adjacent to the branch point is configured to be maintained at a different radio frequency voltage than a second subset of the plurality of orthogonal segments.

6. The system of claim 1, wherein the first branched electrode and the second branched electrode are each configured as a plurality of segments, and a member of the plurality of segments adjacent to a closed ion channel is configured to be held at a same radio frequency voltage as a member of the plurality of orthogonal electrodes.

7. The system of claim 1, wherein the first branched electrode and the second branched electrode are configured as a plurality of segments, and a distance between a first segment of the first branched electrode adjacent to the branch point and a first segment of the second branched electrode adjacent to the branch point is at least four percent greater than a distance between a second segment of the first branched electrode not adjacent to the branch point and a corresponding second segment of the second branched electrode not adjacent to the branch point.

8. The system of claim 1, wherein the same radio frequency voltages are used to alternatively open the first ion channel and the second ion channel by being applied to different members of the first branched electrode, second branched electrode, or members of the plurality of orthogonal electrodes.

9. The system of claim 1, wherein the faces of the first branched electrode and the second branched electrode facing toward the first ion channel are curved.

10. The system of claim 1, further comprising:

a first ion source configured to introduce ions into the ion guide;

a first ion destination configured to receive ions through the first ion channel.

11. The system of claim 10, further comprising a second ion destination configured to receive ions from the second ion channel, or a second ion source.

12. The system of claim 10, wherein the first or second ion destination includes at least one of a mass filter, a chemical analyzer, material to be treated by the ion, a time of flight (TOF) mass analyzer, a quadrupole mass analyzer, a Fourier transform ion cyclotron resonance (FTICR) mass analyzer, a 2D (linear) quadrupole, a 3d quadrupole ion trap, a magnetic sector mass analyzer, a spectroscopic detector, a photomultiplier, or an ion detector.

13. The system of claim 10, wherein the ion source includes at least one of an electron impact (EI) ion source, an electrospray (ESI) ion source, a matrix-assisted laser desorption (MALDI) ion source, a plasma source, an atmospheric pressure chemical ionization (APCI) ion source, a laser desorption ionization (LDI) ion source, an inductively coupled plasma (ICP) ion source, a chemical ionization (CI) ion source, a fast atom bombardment (FAB) ion source, an electron source, or a liquid secondary ions mass spectrometry (LSMIS) source.

14. The system of claim 1, wherein the first branched electrode and the second branched electrode are each shaped to result in a larger inter-electrode distance near the branch point relative to an inter-electrode distance further from the branch point.

15. A method of using a branched radio frequency multipole, the method comprising:

providing first radio frequency voltages to a branched radio frequency multipole such that a first ion channel is opened and a second ion channel is closed, the first ion channel and the second ion channel overlapping in part of the branched radio frequency multipole and diverging at a branch point, the first radio frequency voltages including a first set of voltages applied to a plurality of branched electrodes and a second set of voltages applied to a first plurality of orthogonal electrodes orthogonal to the plurality of branched electrodes, the first set of voltages being approximately 180 degrees out of phase with respect to the second set of voltages;

introducing a first ion from an ion source into the branched radio frequency multipole through an ion inlet and passing the ion to a first ion destination through the first ion channel;

providing second radio frequency voltages to the branched radio frequency multipole such that the first ion channel is closed and the second ion channel is open, the second radio frequency voltages including a first set of voltages applied to the plurality of branched electrodes and a second set of voltages applied to a second plurality of orthogonal electrodes orthogonal to the plurality of branched electrodes, the first plurality of orthogonal electrodes and the second plurality of orthogonal electrodes having some electrodes in common, the second plurality of orthogonal electrodes being adjacent to the second ion channel; and introducing a second ion from the ion source into the branched radio frequency multipole through an ion inlet and passing the ion to a second ion destination through the second ion channel.

16. The method of claim 15, wherein the first or second ion destinations include at least one of a mass filter, a chemical analyzer, material to be treated by the ion, a time of flight (TOF) mass analyzer, a quadrupole mass analyzer, a Fourier transform ion cyclotron resonance (FTICR) mass analyzer, a 2D (linear) quadrupole, a 3d quadrupole ion trap, a magnetic sector mass analyzer, a spectroscopic detector, a photomultiplier, or a ion detector.

17. The method of claim 15, wherein the ion source includes at least one of an electron impact (EI) ion source, an electrospray (ESI) ion source, a matrix-assisted laser desorption (MALDI) ion source, a plasma source, an atmospheric pressure chemical ionization (APCI) ion source, a laser desorption ionization (LDI) ion source, an inductively coupled plasma (ICP) ion source, a chemical ionization (CI) ion source, a fast atom bombardment (FAB) ion source, an electron source, or a liquid secondary ions mass spectrometry (LSMIS) source.

18. The method of claim 15, further comprising introducing collisional gas into the branched radio frequency multipole.

19. A method of using a branched radio frequency multipole, the method comprising:

providing first radio frequency voltages to a branched radio frequency multipole such that a first ion channel is opened and a second ion channel is closed, the first ion channel and the second ion channel overlapping in part of the branched radio frequency multipole and diverging at a branch point, the first radio frequency voltages including a first set of voltages applied to a plurality of branched electrodes and a second set of voltages applied to a first plurality of orthogonal electrodes orthogonal to the plurality of branched electrodes, the first set of voltages having a polarity opposite that of the second set of voltages;

introducing a first ion from a first ion source into the ion guide through a first ion inlet and passing the ion to an ion destination through the first ion channel;

providing second radio frequency voltages to the branched radio frequency multipole such that the first ion channel is closed and the second ion channel is open, the second radio frequency voltages including a first set of voltages applied to the plurality of branched electrodes and a second set of voltages applied to a second plurality of orthogonal electrodes orthogonal to the plurality of branched electrodes, the first plurality of orthogonal electrodes and the second plurality of orthogonal electrodes having some electrodes in common, the first plurality of orthogonal electrodes being adjacent to the first ion channel; and introducing a second ion from a second ion source into the branched radio frequency multipole through a second ion inlet and passing the ion to the ion destination through the second ion channel.

20. The method of claim 19, wherein the ion destination includes at least one of a mass filter, a chemical analyzer, material to be treated by the ion, a time of flight (TOF) mass analyzer, a quadrupole mass analyzer, a Fourier transform ion cyclotron resonance (FTICR) mass analyzer, a 2D (linear) quadrupole, a 3d quadrupole ion trap, a magnetic sector mass analyzer, a spectroscopic detector, a photomultiplier, or an ion detector.

21. The method of claim 19, further comprising filtering the first ion within the branched radio frequency multipole as a function of mass to charge ratio.

22. A multipole structure for controllably guiding ions, comprising:

a plurality of generally planar electrodes defining a first and a second ion channel, the plurality of electrodes including a first electrode set in which each electrode is opposed to a corresponding electrode across a first transverse dimension and a second electrode set in which each electrode is opposed to a corresponding electrode across a second transverse dimension, the first and second dimensions being generally orthogonal; and an RF voltage source for applying RF voltages to at least some of the electrodes of the plurality of electrodes, the RF voltage source being configured to controllably adjust at least one of the phase and the magnitude of an RF voltage applied to one or more electrodes to cause ions to preferentially travel along the first or the second ion channel.

23. The multipole structure of claim 22, wherein the RF voltage source is configured to cause the ions to preferentially travel along the first or the second ion channel by increasing the magnitude of RF voltages applied to electrodes positioned adjacent to a divergent portion of the non-preferred ion channel.

24. The multipole structure of claim 22, wherein the RF voltage source is configured to cause the ions to preferentially travel along the first or the second ion channel by adjusting the phase of RF voltages applied to electrodes positioned adjacent to a divergent portion of the non-preferred ion channel, such that the RF voltages of the same phase are applied to corresponding electrodes of the first and second electrode extending along the non-preferred ion channel.

25. The multipole structure of claim 22, wherein the electrodes of the first electrode set comprise unitary Y-shaped electrodes of unitary construction, and wherein at least some of the electrodes of the second electrode set are segmented along the direction of ion travel.

26. The multipole structure of claim 22, wherein the first electrode set comprises first, second, and third coplanar electrodes, the first electrode extending substantially along the common portion of the first and second ion channels, and the second and third electrodes respectively extending substantially along the divergent portions of the first and second ion channels.

* * * * *